United States Patent [19]

Zabar

[11] Patent Number: 4,926,741

[45] Date of Patent: May 22, 1990

[54] APPARATUS FOR DRIVING A COIL LAUNCHER

[75] Inventor: Zivan Zabar, Forest Hills, N.Y.

[73] Assignee: Polytechnic University, Brooklyn, N.Y.

[21] Appl. No.: 283,254

[22] Filed: Dec. 12, 1988

[51] Int. Cl.[5] ..... F41F 1/02

[52] U.S. Cl. ..... 89/8; 124/3; 310/13; 318/135

[58] Field of Search ..... 89/8; 124/3; 310/13, 310/14; 318/135

[56] References Cited

U.S. PATENT DOCUMENTS

| | | | |
|---|---|---|---|
| 2,235,201 | 2/1941 | Cole | 89/8 |
| 3,435,312 | 3/1969 | De Coster | 318/135 |
| 3,611,783 | 6/1968 | Mittelmann | 89/8 |
| 4,718,322 | 1/1988 | Honig et al. | 89/8 |

FOREIGN PATENT DOCUMENTS

| | | | |
|---|---|---|---|
| 448496 | 6/1936 | United Kingdom | 124/3 |

OTHER PUBLICATIONS

Zabar et al., "Design and Power Conditioning for the Coil-Gun", SPIE Symp. on Innovative Science & Technology, Los Angeles, CA., Jan. 10-15, 1985.

Thorn et al., "Theory of an Electromagnetic Mass Accelerator for Achieving Hypervelocities," NASA TN D-866, Jun. 1961, pp. 7-11, 23, 26.

"Power Conditioner for a Coil-Gun", Zabar et al., Sixth IEEE Pulsed Power Conference, Jun. 29-Jul. 1, 1987.

*Primary Examiner*—Stephen C. Bentley

*Attorney, Agent, or Firm*—Curtis, Morris & Safford

[57] ABSTRACT

A coil launcher having a barrel segmented into sections formed of sets of poly-phase energizable coils which are energized in succession by a power supply comprised of capacitors, with one capacitor coupled to a respective section of coils. A predetermined number of sections of coils disposed at the breech end of the barrel are merged, and the resultant merged section is coupled to a like number of pre-energized capacitors which are connected successively and cumulatively in series to that merged section of coils by way of switch circuits, whereby the number of capacitors connected in series increases over time to increase the level and resonant frequency of energy supplied to that merged section of coils.

15 Claims, 1 Drawing Sheet

FIG. 1
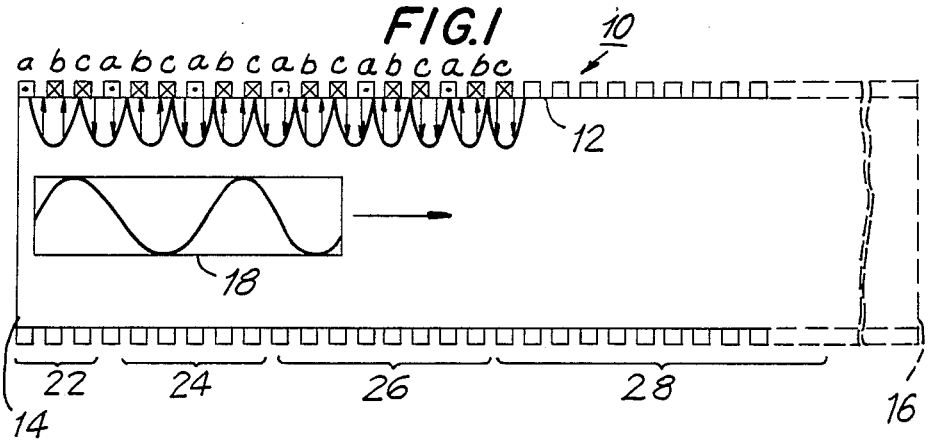
FIG. 2
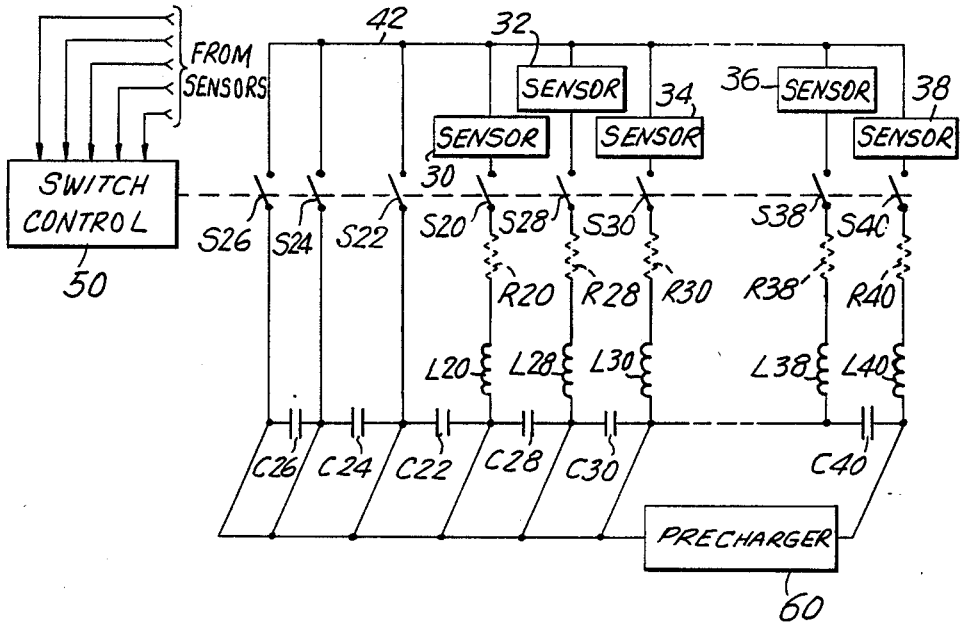
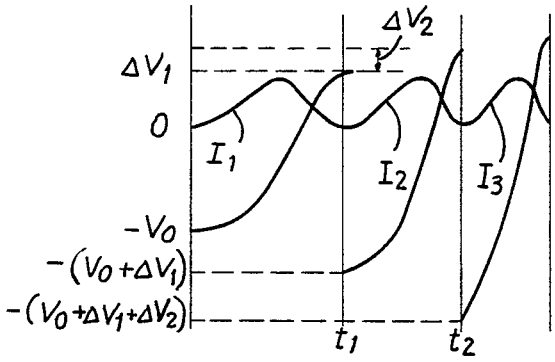
FIG. 3

APPARATUS FOR DRIVING A COIL LAUNCHER

The invention disclosed herein was made with Government support and the Government has certain rights in the invention.

BACKGROUND OF THE INVENTION

This invention relates to a coil launcher and, more particularly, to an improved drive circuit which energizes the coils of the launcher successively and efficiently to accelerate a projectile through the launcher.

Projectile launchers using electromagnetic forces to accelerate a projectile rather than conventional projectile launchers which rely primarily upon gun powder. have been proposed heretofore. Typical of one type of launcher is U. S. Pat. No. 4,718,322 in which parallel rails are energized by power supplies for exerting electromagnetic forces on a projectile that travels along the rails. These so-called rail launchers require extraordinarily high currents, on the order of thousands if not millions of amperes, to accelerate a projectile along the rails. Such high currents present an inherent drawback to the practical utility of a rail launcher.

Another type of launcher has been described as a coil gun, an early example of which is described in U. S. Pat. No. 2,235,201, and further improvements to the coil gun are described in U. S. Pat. No. 3,611,783. Coil guns of the type described in these patents are comprised of sequentially energized induction coils. The presence of the projectile as it moves through the barrel of the coil gun is sensed, as by an optical sensor, thereby controlling the deenergization of one coil and the energization of the next-following coil to accelerate the projectile along the barrel. Although the requisite current levels needed to operate the coil gun are less than those needed to operate a rail launcher, relatively complicated coil drive circuits have been proposed heretofore to achieve successive coil energization.

A proposal for an efficient and practical power conditioner, or drive circuit, for a coil gun is described in the paper entitled "Power Conditioner for a Coil-Gun", authored by Zabar et al. and presented at the Sixth IEEE Pulsed Power Conference in Arlington, Virginia, June 29–July 1, 1987. In the coil gun described in this paper, a barrel is segmented into sections formed of sets of coils. Each section is formed of plural phases, such as three phases, and is sequentially energized, thereby producing a traveling "wave packet" of flux density. A projectile placed in the barrel of the coil gun is provided with a conductive sleeve in which azimuthal currents are induced by the change in flux density. As a result, a force proportional to the product of the induced currents and the flux density is exerted on the projectile and moves axially with the traveling wave packet of flux density. In addition to the axial force, a radial force is exerted on the projectile to keep it positioned on the axis of the air gap included in the barrel, thereby avoiding friction between the projectile and the barrel wall.

Advantageously, the projectile used in this proposal can be provided with discrete coils instead of one cylindrical sleeve.

The aforementioned Zabar et al. paper recognizes that all of the plural-phase sets of coils along the barrel can be excited simultaneously to generate the traveling flux wave. To accelerate the projectile, the frequency of energization of the coils may be constant or, for the sake of efficiency, may increase as the projectile advances from the breech to the muzzle of the gun. However, a suitable power supply having a variable frequency generator adequate to accelerate the projectile is not practical. This is because the frequency of the current supplied to the coils must be increased by at least one order of magnitude as the projectile moves along the length of the barrel. Furthermore, since those coils that are not proximate the projectile during its traversal of the barrel do not generate any significant accelerating force, the energy supplied thereto is wasted until the projectile moves within range.

The power conditioner proposed in the Zabar et al. paper overcomes these deficiencies and disadvantages by segmenting the barrel into sections consisting of sets of coils, by grouping the coils into phase windings in which a number of coils may be connected in series or in parallel, and by connecting a separate power supply to each phase winding of each section. As described therein, each power supply includes a pre-energized capacitor connected in series with a respective phase winding of a respective section. As an example, if ten sections of 3-phase windings are used, a capacitor is connected to each phase in each section, thus resulting in thirty such capacitors. With reference to one phase, switches, such as solid-state switches (e. g. thyristors) are connected in series with the ten phase windings, respectively. When a switch is closed, the phase winding coupled thereto is connected into a series circuit with a capacitor, thereby forming an LC circuit whose resonant frequency is proportional to $1\sqrt{LC}$, wherein L is the inductance of the phase winding connected by the switch and C is the capacitance of the capacitor connected thereto. Since the capacitor is pre-charged, it discharges through the coil to produce an oscillating current whose resonant frequency is proportional to $1\sqrt{LC}$. The current through the coil generates a magnetic flux which, in turn, produces an axial force on the projectile to accelerate it. As a result of the transfer of energy from the coils to the projectile and of the resistive losses in the coils and in the projectile sleeve, the amplitude of the coil current decays with time.

After a few cycles of the coil current, the projectile has, of course, moved along the barrel; each of the phase windings of the barrel section that had been connected to the pre-charged capacitor is disconnected; and the corresponding phase winding of the next section is connected by its switch not only to the capacitor associated with it but also to the previous capacitor. As a result, two capacitors now are connected in series; and the pre-charged voltage across the newly connected capacitor is added to the remaining voltage present across the next preceding capacitor which had been connected in series with the preceding phase winding. It follows that none of the energy initially stored in the capacitor remains unutilized.

As pointed out in the Zabar et al. paper, if the pre-energized capacitors are charged to the same voltage $V_0$ with alternating polarities and the switches are controlled such that the disconnection of one coil and the connection of the next occurs at the time that the decaying current passes through a zero reference level, then, the energy transferred to the projectile through a phase winding increases. Furthermore, as the capacitors are connected successively in series, the overall capacitance decreases so as to increase the resonant frequency of the coil current. Consequently, the linear velocity of the traveling wave packet of flux density also increases to continue the acceleration of the projectile.

Thus, as described in the Zabar et al. paper, by successively increasing the number of capacitors connected in series with each successively energized phase winding, a relatively simple power conditioner is provided to generate increasing voltages at increasing frequencies through successive, individual phase windings for accelerating the projectile until a relatively high muzzle velocity is attained.

It has been found, however, that proper design of a coil gun of the type proposed in the Zabar et al. paper suggests that the overall length of a barrel section and, thus, the number of coils in the phase winding, should be proportional to the average projectile velocity in that section. Since the projectile exhibits the lowest velocity in those sections adjacent the breech end of the barrel, such sections would be too short to be efficient in accelerating the projectile.

Therefore, and in accordance with the present invention, those sections at least at the breech end should be merged. Each merged section should be supplied by a stepwise increase in frequency to match the frequencies of the sections as originally designed.

OBJECTS OF THE INVENTION

Therefore, it is an object of the present invention to provide an improved drive circuit for a coil gun which overcomes the drawbacks and deficiencies mentioned above, yet provides satisfactory acceleration of a projectile at improved efficiencies and reduced power losses.

Another object of this invention is to provide improved, simplified apparatus for driving a coil launcher of the type having several sections of coils constituting a barrel through which a projectile is accelerated, including relatively short coil sections in the vicinity of the breech.

A further object of this invention is to provide a drive circuit for a linear coil launcher which avoids the need to supply excessively high currents to the coils and which attains good initial acceleration of a projectile with good overall efficiency.

Various other objects, advantages and features of the present invention will become readily apparent from the ensuing detailed description, and the novel features will be particularly pointed out in the appended claims.

SUMMARY OF THE INVENTION

In accordance with this invention, apparatus is provided for driving a coil launcher of the type having energizable coils arranged in an array to drive a projectile therewithin. The coils may be connected in series or in parallel to form phase windings. A number of such phase windings forms a section of a barrel. All sets of coils belonging to a section are energized at the same frequency with equal phase delays between adjacent phase windings. The phase windings of one or more sections are merged, and the phase windings of a merged section are connected at one time, sequentially and individually, to a cumulatively increasing series of pre-energized capacitors. As more capacitors are connected in series to energize the phase windings of successive sections of the barrel, the energy stored on the capacitor next connected is added to the energy remaining on those which already are connected.

The present invention is directed in particular to the improvement wherein the phase windings of each merged section are energized by the sequential closing and opening of switches to cumulatively connect capacitors, so that an increasing amount of energy is supplied to the coils forming each phase winding in that merged section. As a feature of this invention, the capacitors are connected cumulatively in series such that, as each capacitor is so connected, not only is the level of the voltage and energy supplied by those capacitors to the phase windings of a merged section increased, but also the resonant frequency increases.

In particular and advantageously, each phase winding of any merged section of the barrel (for example, in a three-phase arrangement, each of phases a, b and c of the breech section) is energized sequentially by the cumulative connection of series capacitors, such that the resonant frequency increases during the transit time of the projectile in that section.

As another feature of this invention the coils belonging to different phase windings are energized with phase delays in time which correspond to their spatial displacement along the barrel. As a result of this plural phase energization of coils, a traveling wave packet of flux density is created in the barrel.

As another feature of this invention, the switches used to connect the capacitors cumulatively in series to the phase windings of a merged section are controlled so as to add a capacitor into the series circuit after a predetermined number of half cycles of the resonant frequency. Thus, a switch is closed when the current supplied to the coils crosses a reference, or zero, level. Preferably, a switch is closed to add a capacitor to the aforementioned series connection only after a predetermined number of cycles of the previous resonant frequency have occurred.

In one particular embodiment of the present invention, all capacitors supplying one phase are connected in series. The phase windings of each section are connected by a respective switch to a respective junction formed by the series-connected capacitors, and each of these switches is closed, mutually exclusively, to form a series circuit between the winding and those capacitors which extend between the winding and the junction to which the closed switch is connected. The next switch is closed as the immediately preceding switch is opened, thereby cumulatively adding capacitors in series with the coils.

As a further aspect of the present invention, the axial length of any merged-section is greater than the length of the projectile sleeve, but the axial length of the constituent sections which are merged is less than the projectile length.

An another aspect of this invention, the projectile payload preferably is housed within a set of discrete coils.

BRIEF DESCRIPTION OF THE DRAWINGS

The following detailed description, given by way of example, will best be understood in conjunction with the accompanying drawings in which:

FIG. 1 is a schematic representation of a linear coil launcher utilizing the present invention;

FIG. 2 is a schematic diagram of apparatus for driving the coil launcher; and

FIG. 3 is a waveform diagram which is useful in understanding the advantages attained by the illustrated drive circuitry.

DETAILED DESCRIPTION OF A PREFERRED EMBODIMENT

Referring now to FIG. 1, there is illustrated a schematic representation of a coil launcher 10 comprised of a breech end 14, a muzzle end 16 and sets of coils 22, 24, 26, 28, etc. which form a barrel 12. A projectile 18 is illustrated as being placed within barrel 12 and is adapted to be accelerated through the air core from the breech to the muzzle in response to magnetic flux generated within the barrel by currents flowing through the illustrated sets of coils. Typically, the projectile is formed with a conductive sleeve, such as an aluminum sleeve, or, preferably, discrete coils, enveloping a suitable payload to be launched.

Advantageously, barrel 12 is segmented into sections to facilitate transport and assembly of the launcher at a field site. Each barrel section consists of an array of coils. Thus, a first section consists of coil array 22, a second section consists of coil array 24, a third section consists of coil array 26, a fourth section consists of coil array 28, and so on. Preferably, and as illustrated, each section of barrel 12 is of a different length, and each section length increases from breech 14 toward muzzle 16. Each section is comprised of plural phases. For instance in the case of FIG. 1, each section consists of three phases of windings. For convenience, these three phases are represented as phases a, b and c; and as will be described, each phase in each section is driven individually. To simplify the present description and facilitate a ready understanding of the present invention, it is assumed that each phase of each coil section is driven by a sinusoidal current. By using three phases in each coil section, a traveling wave, or packet of flux density B is generated down the length of barrel 12.

Each coil section 22, 24, 26, 28, etc. preferably is comprised of an integral number of pole pitches in each phase. For example, and as illustrated, phase a of coil section 22 preferably includes two pole-pitches, as does phase b and also phase c. Phase a of coil section 24 preferably is formed as four pole pitches, as is phase b and also phase c. Phase a of coil section 26 preferably is formed as six pole pitches; and it is appreciated that, as the length of each barrel section increases, the number of pole pitches likewise increases. However, and as will be described, the number of pole pitches in those sections which are merged (e. g. sections 22, 24 and 26) need not be an integral number provided that the merged section is formed as an integral even number of pole pitches.

FIG. 1 assumes a flux density in phase a with a relative value of, for example, 1.0 and the flux density in each of phases b and c (not shown) is assumed to have a relative value of $-0.5$. For simplification, it is assumed that one cycle of flux density is generated in section 22, two cycles are generated in section 24 and three cycles are generated in section 26. Since section 26 is formed of a larger number of coils than section 24, the number of cycles of flux density is larger. Likewise, section 24 is formed of a larger number of coils than section 22, and the number of cycles of flux density produced by section 24 for a given frequency is larger than the number of cycles produced by section 22. The distribution of flux density B in the air gap within barrel 12 thus approximates a sine wave of frequency traveling axially through the barrel at a linear velocity V. The flux density induces azimuthal currents of density J in the conductive sleeve of projectile 18. It is understood that the coil launcher can be provided with a conductive sleeve or, preferably, discrete coils which carry azimuthal currents either induced by the change in flux density or impressed by a suitable source. The interaction between these azimuthal currents and flux density B produces a propulsion force density $F=J\times B$ per unit volume of the projectile sleeve.

The force developed by the interaction between the currents in the coils (or sleeve) of projectile 18 and the magnetic flux generated by the currents flowing in phases a, b and c of coil sections 22, 24, 26, etc., exhibits two components: an axial component which accelerates projectile 18 and a radial component which maintains the projectile along the center line, or longitudinal axis, of barrel 12. This radial force maintains appropriate clearance between the wall of barrel 12 and projectile 18, thereby minimizing friction between the projectile and the barrel.

It will be appreciated that it is not practical to energize phase a (and also phase b and phase c) of all of coil sections 22, 24, 26, 28, etc. simultaneously. That is, it is not practical to connect phase a of coil section 22, coil section 24, coil section 26 and coil section 28 in series or parallel, to connect phase b of all of these sections in series or parallel and to connect phase c of all of these coil sections in series or parallel. Although this would create a wave traveling at constant speed greater than the expected muzzle velocity of projectile 18, needed to accelerate the projectile, such energization would involve energy that is greater than the kinetic energy gained by the projectile along the barrel. This excess energy would be dissipated into heat in the coils (or sleeve); and the heated sleeve might melt. The fraction of energy dissipated into heat in the projectile is proportional to the difference in velocity between the traveling wave and the projectile.

Rather than generate wasted energy by energizing the coils at a constant high frequency, the conversion of input energy into heat can be reduced by progressively increasing the energizing frequency for all of the series or parallel-connected coils over time, that is, as the projectile moves through the barrel. This too, however, is not practical because, at the required power level needed to supply adequate current to the coils, the frequency of the current generator would have to be increased by one order of magnitude during the relatively brief transit time of the projectile, and such current generators are not commercially available. Furthermore, since those coils which reside far behind the instantaneous location of the projectile, as well as those coils which reside ahead of it, do not interact with the coils (or sleeve) of projectile 18, the energy supplied to these coils is not effectively utilized until the projectile moves proximate therewith. These difficulties are addressed by the aforementioned Zabar et al. paper, and they are substantially overcome by sectionalizing barrel 12 and providing individual energization of sections.

Ideally, section 22 should be energized for a few cycles to initiate acceleration of projectile 18. When the projectile moves from its initial position, such as from breech end 14, coil section 22 should be deenergized and section 24 should be energized at a higher frequency, thus reflecting the increased velocity of the projectile. Ideally, the projectile should be further accelerated by the energization of coil section 24 for a few cycles, and then this section should be deenergized and coil section 26 should be energized. This process of successively and sequentially energizing individual coil sections would accelerate the projectile along the length of barrel 12. As an example, in an induction coil launcher, the axial length of a coil section should be proportional to the average velocity of projectile 18 (as explained in the Appendix hereto) as it passes through that coil section. Since the projectile exhibits minimal velocity in the vicinity of breech end 14, coil section 22 would be too short to provide a useful contribution to the flux density B needed to drive the projectile. Similarly, the velocity of the projectile through coil sections 24 and 26 is relatively low, although increasing, and the lengths of these sections also would be too short to provide useful, individual contributions, to the traveling magnetic flux. But, although individual ones of sections 22, 24 and 26 may be too short, it is seen that the combined overall length of these coil sections is sufficient to contribute advantageously to the initial acceleration of the projectile, without substantial loss of input energy and without a significant dissipation of that energy into heat.

In accordance with the present invention, phase a of sections 22, 24 and 26 are connected in series, although these coil sections may, if desired, be connected in parallel. For the purpose of the present discussion, it will be assumed that each phase a of the section are connected in series. Likewise, phase b of these coil sections are connected in series as are phase c. The frequency of the current flowing through the series-connected coils in sections 22, 24 and 26 increases while projectile 18 accelerates; and as will be described below, the magnitude of the current may also increase with the increase in frequency. Even though the projectile accelerates, its actual velocity remains less than the speed of the traveling wave packet of flux density B, thereby inducing currents in the sleeve of the projectile. Those of ordinary skill in the art will appreciate that the projectile thus acts as the rotor of an asynchronous motor whose stator is formed of the coils of sections 22, 24 and 26.

Once the velocity of projectile 18 brings the projectile into a barrel section whose length is equal to or greater than the length of the projectile, the coils in that section are energized individually while the projectile passes therethrough. For example, three coil sections 22, 24 and 26 may be connected in series and, thus, energized concurrently, and this may be all that is needed to accelerate the projectile to a satisfactory velocity. When the projectile enters the fourth section 28, this section may be energized by itself for a number of cycles sufficient to continue the acceleration of the projectile. As the projectile leaves coil section 28 and passes into the next coil section, section 28 is deenergized and the next-following coil section is energized. This sequential energization of successive coil sections continues, thereby continuing the acceleration of the projectile to launch it from muzzle 16. Consequently, a step-wise accelerating packet of magnetic flux density forces the projectile to progress along the length of barrel 12 with increasing velocity.

Advantageously, sections 22–28, etc., can be energized in a so-called open loop arrangement. That is, the actual position of projectile 18 within barrel 12 need not be sensed to control the energization of the respective coils. Rather, the concurrent energization of coil sections 22, 24 and 26 can be controlled simply as a function of the current flowing therethrough. Likewise, the sequential energization of successive coil sections 28, etc. can be controlled simply as a function of the number of half cycles of energizing current that have been supplied.

Preferably, the length of the sleeve of projectile 18 is equal to the period, or an integral number of periods, of the sinusoidal distribution of flux density generated by a respective phase, such as phase a, of a coil. In the example shown in the schematic representation of FIG. 1, the length of the sleeve is illustrated as being equal to two sine wave periods.

Turning now to FIG. 2, there is illustrated a preferred embodiment of a drive circuit for energizing one of the phases, such as phase a, of coil sections 22, 24, 26, 28, etc. It will be recognized that a similar drive circuit is used to energize phase b, and yet another, similar drive circuit is used to energize phase c. The phase winding in each coil section is represented by an inductor L, whereby the phase winding in section 28 is represented by inductor L28, the phase winding in section 30 (not shown) is represented by inductor L30, and so on. In the present invention, coil sections 22, 24 and 26 are merged so as to be connected in series (or, as mentioned above, and if desired, in parallel); and the phase winding of this merged section is represented in FIG. 2 as inductor L20. FIG. 2 also provides a representation of the resistance in the phase winding of each section as well as the effective resistance of the sleeve of projectile 18. It will be appreciated that, when a phase winding is energized, its resistance together with the effective resistance of the projectile-sleeve (or coils) presents a resistance to the current flowing through the energized phase winding. This combined resistance is represented in FIG. 2 as R. Thus, when the phase windings of merged sections 22, 24 and 26 are energized concurrently, an effective resistance R20 is presented. When coil section 28 is energized, the effective resistance presented to the energizing current is shown in FIG. 2 as R28. This effective resistance is illustrated in broken lines to indicate that each resistor is comprised of the resistance presented by the moving projectile and is not a discrete resistive element.

A series of capacitors C22, C24, C26, C28, etc. is adapted to be pre-charged with DC voltage; and the pre-charged voltage across each capacitor is used to supply energizing currents through the respective coil sections. In one embodiment, the polarities of these initial voltages may alternate, and in another, the polarities may all be the same. In a still further embodiment, the polarities of selected initial voltages may be reversed. The Appendix indicates how the magnitude and polarity of these initial voltages should be determined. A pre-charger circuit 60 is coupled to capacitors C22–C28, etc. for the purpose of energizing the capacitors to preset, pre-charged levels.

The phase winding in a section is connected in series with a switch, such as a solid-state switch formed, for example, as a thyristor, a thyratron, a spark gap device, a transistor or other conventional switching device and adapted, when activated, to permit energizing current to flow through the winding. Thus, switch S28 is connected in series with the phase winding of the section represented by inductor L28, switch S30 is connected in series with inductor L30, and so on. In the present invention wherein coil sections 22, 24 and 26 are merged and represented by inductor L20, a single switch S20 is connected in series therewith. A current sensor also is connected in series with each coil section, or inductor, and for the case wherein sections 22, 24 and 26 are merged, a current sensor 30 is connected in series with this merged section. Thus, as shown in FIG. 2, current sensor 30 is connected in series with inductor L20, current sensor 32 is connected in series with inductor L28, current sensor 34 is connected in series with inductor L30, and so on. As will be described, the purpose of each current sensor is to sense when the current flowing through the inductor connected therethrough crosses a reference level, such as zero. It is advantageous to activate switches S20–S30, etc., one-at-a-time, and in sequence, when the energizing current through a coil section crosses this reference level, as will be described. Accordingly, sensors 30–34, etc. are coupled to a switch control circuit 50 which, in turn, supplies trigger signals to selected ones of switches S20–S30, etc.

As illustrated, switch S22 is connected to the junction defined by series-connected capacitors C22 and C24, switch S24 is connected to the junction defined by the series-connected capacitors C24 and C26, and switch S26 is connected between capacitor C26 and a common terminal. Assuming that switch S20 is closed, a series-connected circuit is formed between inductor L20, resistor R20 and capacitor C22 when switch S22 is closed. If switch S22 is opened and switch S24 is closed, the series-connected circuit includes capacitors C22 and C24. Similarly, if switch S24 is opened and switch S26 is closed, the series-connected circuit now includes capacitors C22, C24 and C26.

Energizing current first is supplied to inductor L20, that is, to merged coil sections 22, 24 and 26, to initiate projectile acceleration. After inductor L20 has been energized, the next inductor L28, representing coil section 28, is energized. It is recognized that this successive energization is achieved simply by maintaining switch S26 closed, and then opening switch S20 while closing switch S28. As a result, inductor L28, together with effective resistor R28 now are connected in series with capacitors C22, C24, C26 and C28. After this inductor is energized, switch S28 is opened and switch S30 is closed, thereby connecting inductor L30 and effective resistor R30 in series with capacitors C22–C30. It is recognized that the opening and closing of switches S20–S30 is controlled by switch control circuit 50 in response to the current levels sensed through inductors L20, L28 and L30 by current sensors 30, 32 and 34.

The manner in which the drive circuit illustrated in FIG. 2 operates now will be described in conjunction with the waveforms shown in FIG. 3. It is appreciated that the closure of selected switches S20–S30, etc. forms various series-connected LC circuits, each circuit having a resonant frequency equal to $1\sqrt{LC}$, wherein L is the inductance of the phase winding of the section included in the circuit and C is the capacitance of the series-connected capacitors then connected to the coil section. Thus, current alternates at the resonant frequency $\omega$ through the phase winding then connected to the capacitors. In the interest of clarity, and for simplification, a current swing of only one-half cycle in each circuit, or loop, is assumed. Let it be further assumed that each capacitor exhibits an initial, pre-charged condition of voltage $V_o$ of alternating polarity, and all capacitors have the same value. Switches S20–S30, etc. also are assumed to be open. Now, switch control circuit 50 closes switches S20 and S22 to form a series circuit, or loop, of inductor L20, resistor R20 and capacitor C22. Current flows through inductor L20 and resistor R20, and energy is dissipated in this resistor. However, the remaining energy, which is the majority of the energy supplied to the inductor, reverses the charge across capacitor C22; and at time $t_1$, shown in FIG. 3, current $I_1$ flowing in this loop crosses the zero level. This zero crossing of current $I_1$ is sensed by current sensor 30 which triggers switch control circuit 50 to open switch S22 and close switch S24. The loop now containing inductor L20 includes capacitors C22 and C24, connected in series and with additive polarities. The voltage across C24 is equal to the initial, pre-charged voltage $V_o$, and the voltage now remaining across capacitor C22 is of the same polarity as that across capacitor C24 and is assumed to be equal to $\Delta V_1$. Thus, at the instant that switch S24 is closed and switch S22 is opened, the voltage applied to inductor L20 is equal to $(V_o+\Delta V_1)$ This increased voltage drives a current of greater magnitude through the inductor and, thus, through the merged sections 22, 24 and 26. In addition, since the capacitance of series-connected capacitors C22 and C24 is half that of capacitor C22, the resonant frequency of the loop now containing inductor L20 has been increased by a factor of $\sqrt{2}$. It is appreciated, therefore, that the energizing current now supplied to inductor L20 is of greater magnitude and greater frequency than was supplied when switch S22 was closed. Again, assuming only a half cycle in the current swing through inductor L20, current sensor 30 senses the zero crossing of current $I_2$ through inductor L20 at time $t_2$, whereupon switch control circuit 50 is triggered to open switch S24 and close switch S26. At this time, the voltage charge across capacitors C22 and C24 will reverse, thereby adding to the polarity across capacitor C26. The voltage now supplied to inductor L20 is equal to the sum of the voltages across capacitors C22, C24 and C26 which is seen to be $V_o$, the pre-charged voltage across capacitor C26, plus the voltage $\Delta V_1$, the voltage now remaining across capacitor C24, plus the voltage $\Delta V_2$, the voltage remaining across capacitor C22. Hence, a voltage supplied to the loop containing inductor L20 is equal to $(V_o+\Delta V_1+\Delta V_2)$ This results in a greater current through inductor L20; and the resonant frequency has been further increased by the connection of capacitor C26 in series with capacitors C24 and C22.

The manner in which the parameters of an induction coil launcher and its drive circuit are determined is mathematically explained in the Appendix hereto.

While the present invention has been particularly shown and described with reference to a preferred embodiment, it will be readily apparent to those of ordinary skill in the art that various changes and modifications may be made. For example, although each of the switches S20–S30, etc., has been described as being closed only for a half swing of current through the coil section connected thereto, in a preferred embodiment each switch remains closed for an integral number of half swings of current, such as, for example, at least two full swings of current. To minimize disturbances, perturbation, noise and interference, a switch should be opened or closed when the coil current, as sensed by current sensor 30, 32, etc., crosses a zero reference level.

In the embodiment described above, three coil sections disposed at the vicinity of the breech end of barrel 12 are merged to be energized concurrently in response to the closing of switches S22, S24 and S26. It is appreciated that, if desired, a greater or lesser number of coil sections may be merged. Furthermore, if the acceleration of the projectile is such that the projectile passes through sections 22 and 24 after a few (e. g. four) cycles of current half-swings, it may be desirable to merge coil sections 26 and 28 to be energized concurrently. In this alternative, capacitor C22 and then the series connection of capacitors C22 and C24 are connected into a loop with a phase winding of merged coil sections 22 and 24. Then, capacitors C22–C26 are connected into a loop with a phase winding of merged coil sections 26 and 28, followed by the series of capacitors C22–C28. It will be seen, therefore, that in the vicinity of the breech end of barrel 12 two (or more) sections of coils may be merged. Of course, once the projectile gains suitable velocity, the remaining coil sections may be energized one section at-a-time, as by connecting only that coil section into the loop formed by multiple series-connected capacitors.

It is intended that the appended claims be interpreted as including the specific embodiment described herein, the foregoing alternatives and modifications, and all other equivalents thereto.

What is claimed is:

1. Apparatus for driving a coil launcher of the type having multiple energizable coils arranged in sections to drive a projectile therewithin and unconnected to said coils, said apparatus comprising a plurality of pre-energized capacitance means cumulatively connected, one-at-a-time to sequential individual ones of said coil sections to add energy stored on previously connected capacitance means to the energy stored on the capacitance means next connected, whereby increasing energy at increasing AC frequency is supplied to successive ones of said coil sections, the improvement comprising a number of switch means connected to respective ones of said capacitance means; and means for activating said switch means one-at-a-time to cumulatively connect said capacitance means for supplying increasing energy concurrently to a predetermined plurality of said coil sections, the capacitance of the cumulatively connected capacitance means and the inductance of the predetermined plurality of coil sections determining a resonant frequency which increases as said capacitance means are cumulatively connected.

2. The apparatus of claim 1 wherein at least said predetermined plurality of coil sections include poly-phase windings, said number of switch means include poly-phase switching devices, and said number of capacitance means include poly-phase capacitance means; and further comprising phase control means for activating said number of switching devices in a respective phase, one-at-a-time, to cumulatively connect the number of capacitance means in said phase for supplying increasing energy concurrently to the phase windings of said predetermined plurality of coil sections of said phase.

3. The apparatus of claim 2 wherein said projectile comprises at least one coil enveloping a payload and driven in the axial direction relative to the coils of said launcher.

4. The apparatus of claim 2 wherein the predetermined plurality of coil sections are merged to form a merged section.

5. The apparatus of claim 4 wherein the inductance of the merged coil sections in said phase and the capacitance of the capacitance means connected to said merged coil sections at any given time determines resonant frequency $\omega$; and wherein the means for activating said switching devices in said phase one-at-a-time increases said resonant frequency.

6. The apparatus of claim 5 wherein individual ones of the capacitance means of said phase are connected successively and cumulatively in series as said switching devices in said phase are activated one-at-a-time.

7. The apparatus of claim 6 wherein said means for activating said switching devices in said phase connects a succeeding capacitance means in series after a predetermined number of half cycles of the resonant frequency $\omega$ last determined by the prior connection of capacitance means.

8. The apparatus of claim 7 wherein said means for activating said switching devices connects a capacitance means in series when the level of the current supplied to said phase winding of a coil section crosses a zero reference level.

9. A drive circuit for a linear coil launcher of the type having sections of coils for accelerating a projectile through a barrel with a breech end and a muzzle end, each coil section being formed of plural phases, the drive circuit for each phase comprising:

plural power supplies each coupled to a respective one of a like plurality of coil sections for energizing successive sections to accelerate said projectile; and a predetermined number of coil sections disposed at the breech end of said barrel being merged to comprise a merged section coupled to a like predetermined number of power supplies for energizing said merged section concurrently, said predetermined number of power supplies including:

a predetermined number of pre-energized capacitance means, and a predetermined number of switch means each being individually operated to connect a successive one of said predetermined number of capacitance means in series to said merged section of coils such that the number of capacitance means connected in series increases over time to increase the level and resonant frequency of energy supplied to said merged section of coils.

10. The drive circuit of claim 9 wherein said plural phases are equal to three phases.

11. The drive circuit of claim 9 wherein said resonant frequency is inversely proportional to $\sqrt{LC}$, where L is the effective inductance of said merged section of coils and C is the effective capacitance of the series-connected capacitance means at any given time.

12. The drive circuit of claim 11, further including switch energizing means for changing over the series connection of capacitance means after a predetermined number of half cycles of said resonant frequency.

13. The drive circuit of claim 12 wherein said coils in the merged section are connected in series with each other and with said series-connected capacitance means.

14. The drive circuit of claim 12 wherein said predetermined number of capacitance means are connected in series to define junctions therebetween; wherein each of said predetermined number of switch means is connected between a respective junction and a common terminal and is energized individually to connect an increased number of series-connected capacitance means to said common terminal; and wherein the merged section is connected between said common terminal and the series-connected capacitance means.

15. The drive circuit of claim 14 further including additional switch means for coupling said merged section to said common terminal and operated by said switch energizing means to disconnect said merged section from said common terminal after said projectile passes through said merged section so as to de-energize the coils therein.

* * * * *

UNITED STATES PATENT AND TRADEMARK OFFICE

CERTIFICATE OF CORRECTION

PATENT NO. : 4,926,741

DATED : May 22, 1990

INVENTOR(S) : Zivan Zabar

It is certified that error appears in the above-identified patent and that said Letters Patent is hereby corrected as shown below:

Claim 5, line 4, column 11, line 63, after "determines" insert --said--.

Signed and Sealed this

Sixth Day of August, 1991

*Attest:*

*Attesting Officer*

HARRY F. MANBECK, JR.

*Commissioner of Patents and Trademarks*